US007564007B2

(12) United States Patent
Bailey

(10) Patent No.: US 7,564,007 B2
(45) Date of Patent: Jul. 21, 2009

(54) KILN REMOVABLE CERAMIC ELEMENT HOLDER

(76) Inventor: James G. Bailey, 415 Lapla Rd., Kingston, NY (US) 12401

( * ) Notice: Subject to any disclaimer, the term of this patent is extended or adjusted under 35 U.S.C. 154(b) by 10 days.

(21) Appl. No.: 11/748,247

(22) Filed: May 14, 2007

(65) Prior Publication Data

US 2008/0286709 A1 Nov. 20, 2008

(51) Int. Cl.
*H05B 3/66* (2006.01)
*F27D 11/02* (2006.01)

(52) U.S. Cl. ..... 219/403; 219/406; 219/408; 219/411; 373/130

(58) Field of Classification Search ..... 373/130; 219/403
See application file for complete search history.

(56) References Cited

U.S. PATENT DOCUMENTS 858,012 A 6/1907 Murrin
1,318,463 A 10/1919 Scharawath
1,346,854 A * 7/1920 Smalley ..... 373/130
1,657,453 A 1/1928 Boyd
1,830,438 A 11/1931 Miller
2,035,306 A * 3/1936 Fannin ..... 373/130
2,139,201 A * 12/1938 Bengt ..... 373/130
2,202,874 A * 6/1940 Smalley ..... 373/130
2,223,215 A 11/1940 Kunz et al.
2,239,896 A 4/1941 Kuhner et al.
2,634,694 A 4/1953 Hazen
2,744,946 A * 5/1956 Lewicki ..... 373/119
2,963,529 A * 12/1960 Schmidt ..... 373/119
2,985,442 A 5/1961 Hilber
3,078,830 A 2/1963 Evans
3,599,912 A 8/1971 Stephens
3,786,162 A * 1/1974 Colson ..... 373/119
4,188,915 A 2/1980 Kummel et al.
4,418,415 A * 11/1983 Raymond ..... 373/130

(Continued)

FOREIGN PATENT DOCUMENTS

JP 01285788 A * 11/1989

*Primary Examiner*—Joseph M Pelham
(74) *Attorney, Agent, or Firm*—Joseph L. Spiegel; Heslin Rothenberg Farley & Mesiti P.C.

(57) ABSTRACT

A kiln of the pottery or glass type and of insulating firebrick or ceramic fiber with an interior wall includes: a ceramic holder for holding a wound electrical heating element; a channel in the interior wall for receiving and supporting the ceramic holder. The ceramic holder is removably positionable within the slot with means for receipt and holding the wound electrical heating element when the ceramic holder is positioned within the channel in a first preferred embodiment, the ceramic holder has a supporting surface for receipt of the heating element and an inner, upper lip for holding the heating element on the ceramic holder. The interior wall has a horizontal retaining slot aligned with the ceramic holder supporting surface, the supporting surface has an outer end received within the retaining slot and an inwardly angled bore and a pin passing through the bore into the interior wall for holding the ceramic holder removably in place. In an alternate embodiment, the channel has an upper outwardly projecting corner and a lower vertical slot, the ceramic element holder has a vertical outer wall integral with the supporting surface with an upper end for positioning and pivoting within the upper corner and an outer lower lip for positioning within the lower vertical slot when the ceramic element holder is positioned in place.

2 Claims, 2 Drawing Sheets

U.S. PATENT DOCUMENTS 4,553,246 A * 11/1985 Christie ..... 373/130
4,733,620 A 3/1988 Robbins
4,768,447 A 9/1988 Roumeguere
4,791,769 A 12/1988 Miller
4,840,131 A 6/1989 Meumann et al.
4,900,249 A 2/1990 McCollum et al.
6,008,477 A * 12/1999 Nakao et al. ..... 219/390
6,807,220 B1 * 10/2004 Peck ..... 373/128

* cited by examiner

KILN REMOVABLE CERAMIC ELEMENT HOLDER

BACKGROUND OF THE INVENTION

1. Field of the Invention

The present invention relates to pottery and glass kilns, and, in particular, to an improvement that allows for quick removal and replacement of the hard ceramic holder that is used for holding the wound electrical heating element within the kiln.

2. Description of the Prior Art

Pottery and glass kilns, typically of insulating brick, utilize electrical elements that are wound coils made of special metal alloys for heating.

These heating elements have traditionally been placed and held in position in channels located in the interior wall of the kiln.

The heating elements are wound like a spring and then stretched to fit into the length of a designated channel around the inner circumference or perimeter of the kiln's interior wall.

These channels are formed by routing a groove with a retaining lip into the kiln's brick to allow entry of the heating element into the wall of the kiln. Once in position, the heating element is retained by a fragile brick vertical lip and pressing or pinning the element in place to prevent it from jumping back into the interior chamber of the kiln.

Heating elements have also been held in place in hard ceramic extruded holders that are embedded permanently into the softer insulating brick and not readily changed.

A problem with both of these prior art heating element retention systems where the elements are held in channels is that the heating elements can fuse into the soft insulating brick or the hard ceramic holder due to over-firing, or electrical arcing, thus melting the element into the brick or ceramic holder.

Another problem occurs when ceramic glaze accidentally lands on the heating element and holder which then melts and fuses the heating element into the holder. Once element and holder become fused, it is very difficult to repair. The soft brick melts away and breaks down with the fusion. Thus, removing the damaged element removes sections of the soft brick which cannot be repaired. This compromises the ability of the replacement element to stay in its position in the channel.

Additionally, hard ceramic element holders which become fused to the heating element cannot be removed from the kiln and removing just the heating element from the channel is extremely time consuming and difficult.

Both type heating element retention systems that have been damaged are difficult, if not impossible to decontaminate of glaze spills or burnout of the brick. As a result, remaining debris from a glaze accident, by over-firing, melt down and can contaminate a replacement heating element causing it to fail prematurely. The heating elements are expensive, so premature loss due to contamination within a channel is very expensive.

Traditionally, the only recourse the operator has had to fix this type of damage required dismantling of the entire kiln, which is time consuming, expensive and beyond the technical ability of most users of such a product.

It is towards a solution to these problems that the present invention is directed.

SUMMARY OF THE INVENTION

An object of the present invention is a quick-change system for placement of a holder for an electrical heating element from within the interior chamber of a pottery or glass kiln and even subsequent to initial assembly of the kiln.

Another object is such a holder that securely holds an electrical heating element in place within the kiln.

Still another object is such a system that allows removal and replacement of a ceramic element holder, should it become damaged, without the need for dismantling the kiln.

These and other objects, features and advantages are accomplished in accordance with the teachings of the present invention, one illustrative embodiment of which comprises a kiln of the pottery or glass type and of insulating firebrick or ceramic fiber with an interior wall that includes: a ceramic holder for holding a wound electrical heating element; and, a channel in the interior wall for receiving and supporting the ceramic holder. The ceramic holder is removably positionable within the slot with means for receipt and holding the wound electrical heating element when the ceramic holder is positioned within the channel. In a first preferred embodiment, the ceramic holder has a supporting surface for receipt of the heating element and an inner, upper lip for holding the heating element on the ceramic holder. The interior wall has a horizontal retaining slot aligned with the ceramic holder supporting surface, the supporting surface has an outer end received within the retaining slot and an inwardly angled bore and a pin passing through the bore into the interior wall for holding the ceramic holder removably in place. In an alternate embodiment, the channel has an upper outwardly projecting corner and a lower vertical slot, the ceramic element holder has a vertical outer wall integral with the supporting surface with an upper end for positioning and pivoting within the upper corner and an outer lower lip for positioning within the lower vertical slot when the ceramic element holder is positioned in place.

BRIEF DESCRIPTION OF THE DRAWINGS

Other objects, features and advantages of the present invention will be apparent from the following detailed description and accompany drawing, wherein.

DETAILED DESCRIPTION OF THE DRAWINGS

Figure 1:
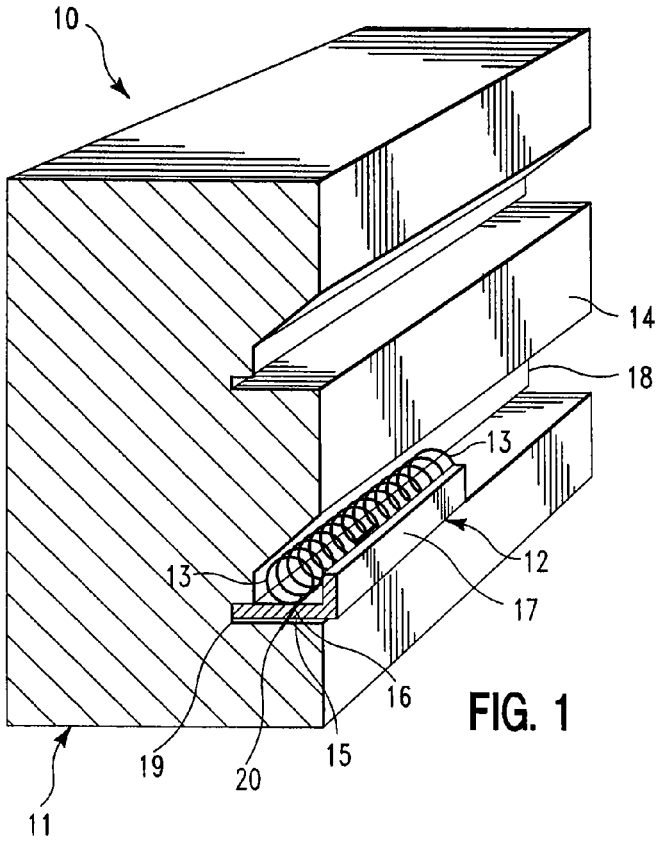
FIG. 1 is a perspective view of an insulating block within a pottery or glass kiln.
Figure 3:
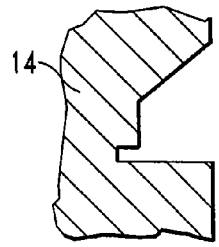
FIGS. 3 through 6 are progressive side views showing installation of a ceramic element holder into the insulative wall and then the electrical element being installed in a channel in a pottery or glass kiln.
Figure 4:
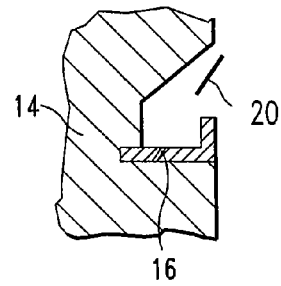
Figure 2:
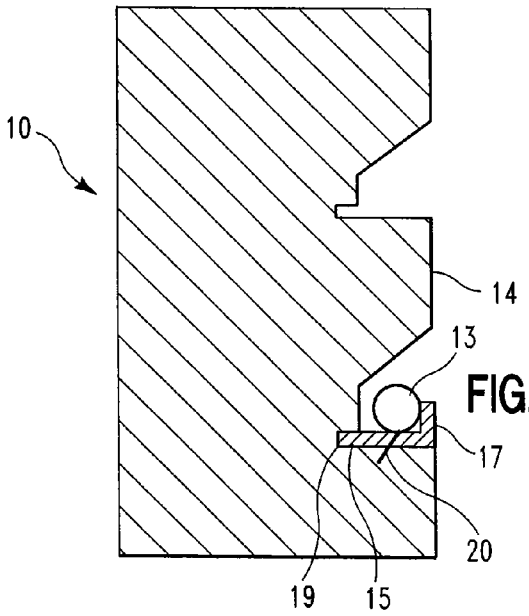
FIG. 2 is a side view of a portion of the insulative wall in a pottery or glass kiln.

Referring now to the drawing, and to FIGS. 1 and 2, so much of a pottery or glass kiln 10 is shown as is necessary for an understanding of the present invention.

In this preferred embodiment, there is shown the wall 11 of a pottery kiln, typically of a soft, lightweight, somewhat porous, insulating brick or ceramic fiber, a hard ceramic element holder 12 and a wound electrical heating element 13. The inner surface of the wall is indicated at 14.

The ceramic element holder 12 has a horizontal supporting surface 15 with an inwardly angled bore 16 therethrough and an inner vertical lip 17 facing the interior of the kiln chamber.

The inner surface 14 of the kiln wall is provided with a channel 18 that has at its lower end a horizontal retaining slot 19 that projects into the wall 11.

Figure 5:
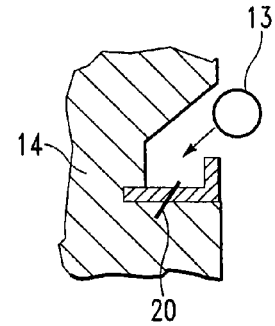
Figure 6:
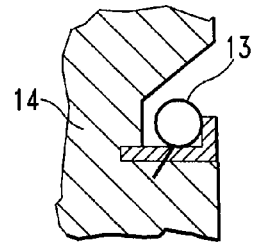

In use and as shown in progressive FIGS. 3 through 6, the element holder 12 is introduced from within the kiln chamber into the channel (FIGS. 3 and 4) until the outer end of the supporting surface fits within the retaining slot 19. Then, a high temperature pin 20 is inserted through the bore 16 in the holder 12 and driven into the wall 11 of the kiln 10. The holder 12 is now ready for receipt of a wound electrical heating element 13 (FIGS. 5 and 6).

To replace a ceramic element holder, the pin 20 is pulled and withdrawn and the holder is simply pulled from the channel.

Figure 1A:
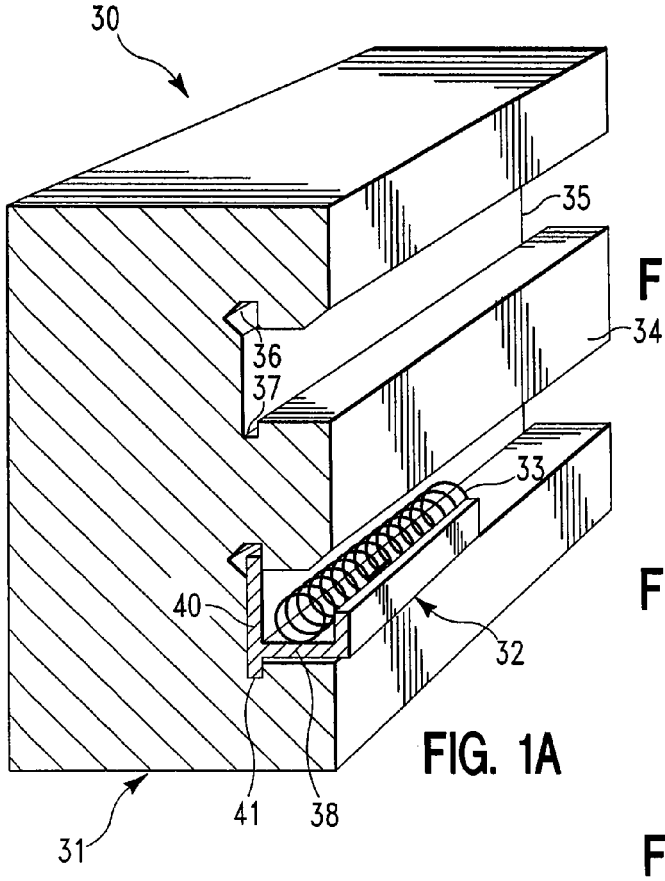
FIG. 1A is a perspective view of the insulative wall in a portion of a pottery or glass kiln.
Figure 2A:
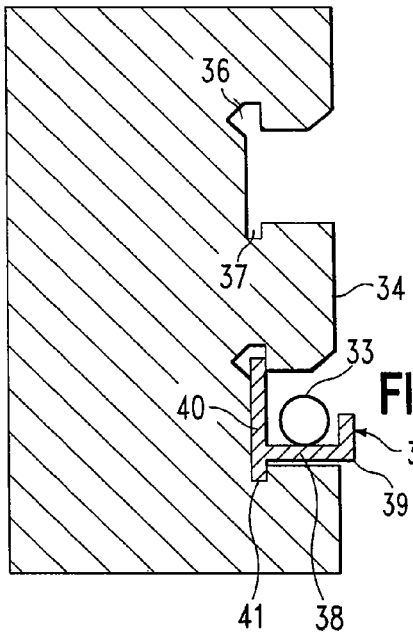
FIG. 2A is a side view of a portion of the insulative wall in a pottery or glass kiln; and, FIGS. 3A through 7A are progressive side views showing installation of a ceramic element holder into the insulative wall and then the electrical element being installed in a channel in a pottery or glass kiln.
Figure 3A:
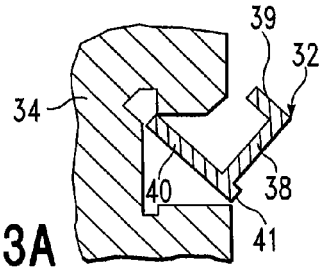

An alternate embodiment of the invention is shown at FIGS. 1A and 2A. In this embodiment, there is shown the wall 31 of a pottery kiln 30, a hard ceramic element holder 32 and a wound electrical heating element 33. The inner surface of the wall is indicated at 34.

The inner surface 34 of the kiln wall 31 is provided with a channel 35. At the outer end of the channel 35, at its upper end, there is an outwardly projecting corner 36 and at the lower end a retaining slot 37. The corner 36 is cut in such manner that the ceramic element holder 32 can gain entry into the channel 35 and go high enough so that it can ultimately be dropped into correct, holding position.

The ceramic element holder 32 is seen as having: a horizontal supporting surface 38 that provides the holding section for the element 33; an inner upper vertical lip 39 facing the interior of the kiln chamber for retaining the heating element in position and preventing it from falling into the interior of the kiln; and, a vertical outer wall 40 connected to the horizontal supporting surface. The vertical wall 40 is also provided with a small lower lip 41 extending below the horizontal supporting surface 38. When in position the wall 40 rests against the kiln wall in the channel 35, while the lower lip 41 fits into the retaining slot 37 in the pottery wall.

Figure 4A:
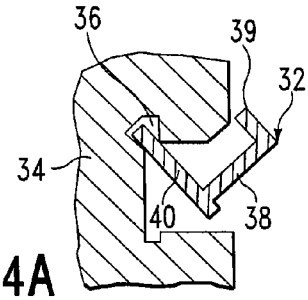

In use, and as shown in progressive FIGS. 3A through 7A, the ceramic element holder 32 is introduced from within the kiln chamber at an angle into the channel 35 (FIG. 3A) until the top of the holder outer wall 40 is within the upper corner 36 (FIG. 4A).

Figure 5A:
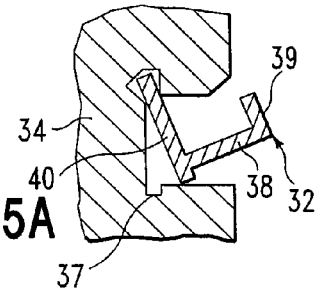
Figure 6A:
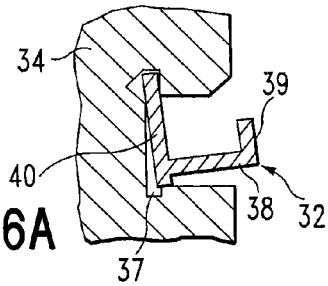
Figure 7A:
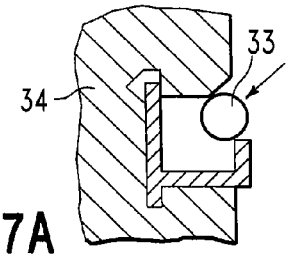

Then the holder 32 is pivoted within the channel (FIGS. 5A and 6A) into its final resting place (FIG. 7A). The electrical element 33 may then be introduced into the holder (FIG. 7A). Of course, if for some reason one wishes to remove the element only, from the interior of the kiln, it is done with the holder 32 in the position as shown in FIG. 7A.

It should be obvious that changes, additions and omissions may be made in the details and arrangement of parts without departing from the spirit and scope of the invention as hereinafter claimed.

The invention claimed is:

1. In a kiln of the pottery or glass type and of insulating firebrick or ceramic fiber, the improvement comprising:

a hard ceramic holder having a supporting surface with an outer end and an inner, upper lip, the lip and supporting surface for receipt of and holding a wound electrical heating element on the ceramic element holder, and an inwardly angled bore in the supporting surface;

the kiln having an interior wall with an inner surface;

a channel in the inner surface with a horizontal retaining slot projecting into the interior wall, aligned with the ceramic holder supporting surface, the supporting surface outer end for receipt within the horizontal, retaining slot; and, a pin passing through the angled bore into the interior wall for holding the ceramic holder removably in place.

2. In a kiln of the pottery or glass type and of insulating firebrick or ceramic fiber, the improvement comprising:

a hard ceramic holder having an upper, vertical, outer wall, a supporting surface with an outer, lower lip and an inner, upper lip, the upper lip and supporting surface for receipt of and holding a wound electrical heating element on the ceramic element holder; the kiln having an interior wall with an inner surface; and, a channel in the inner surface having an upper, outwardly projecting corner and a lower, outer, vertical retaining slot projecting into the interior wall, the supporting surface outer, lower lip for receipt within the outer, vertical slot, the ceramic holder upper, vertical, outer wall positionable and pivotable within the upper, outwardly projecting corner, and the ceramic holder outer, lower lip positionable within the outer retaining slot when the ceramic holder is being positioned within place.

* * * * *